United States Patent [19]

Kelly

[11] 4,254,796

[45] Mar. 10, 1981

[54] GAS REGULATOR VALVE WITH STEP OPENING CHARACTERISTIC

[75] Inventor: Samuel T. Kelly, Torrance, Calif.

[73] Assignee: Robertshaw Controls Company, Richmond, Va.

[21] Appl. No.: 86,166

[22] Filed: Oct. 18, 1979

[51] Int. Cl.[3] ..... F16K 31/365

[52] U.S. Cl. ..... 137/489; 137/495

[58] Field of Search ..... 137/495, 488, 489, 489.5, 137/492, 492.5

[56] References Cited

U.S. PATENT DOCUMENTS

| | | | |
|---|---|---|---|
| 3,513,873 | 5/1970 | Graham | 137/495 |
| 3,552,430 | 1/1971 | Love | 137/495 |
| 3,685,732 | 8/1972 | Haskins | 137/495 X |
| 3,721,263 | 3/1973 | Visos | 137/495 |

*Primary Examiner*—Alan Cohan

*Attorney, Agent, or Firm*—Fulwider, Patton, Rieber, Lee & Utecht

[57] ABSTRACT

There is disclosed a fast-resetting, step-opening gas regulator valve of the diaphragm pressure controlled operation which has an internal bleed cavity and a bleed passageway communicating through a snap-acting valve responsive to a heating demand electromagnet and a spring-biased regulator valve that responds to the outlet pressure. The valve structure has a step opening characteristic which is provided by a balancing of pressures and regulator valve spring force in which the development of gas pressure behind a diaphragm controlling the step opening operation is limited by a flow-restricting orifice. The flow restricting orifice initially provides a low gas pressure and, within a constant and relatively short time interval thereafter, an increased gas pressure to the step opening diaphragm, to provide an initial partial and subsequent full opening of the main gas valve. The fast-resetting of the gas regulator valve is provided by the restricted orifice valve which permits unrestricted, reverse gas flow to relieve the actuating gas pressure on the diaphragm controlling the step opening operation.

10 Claims, 10 Drawing Figures

FIGURE 3
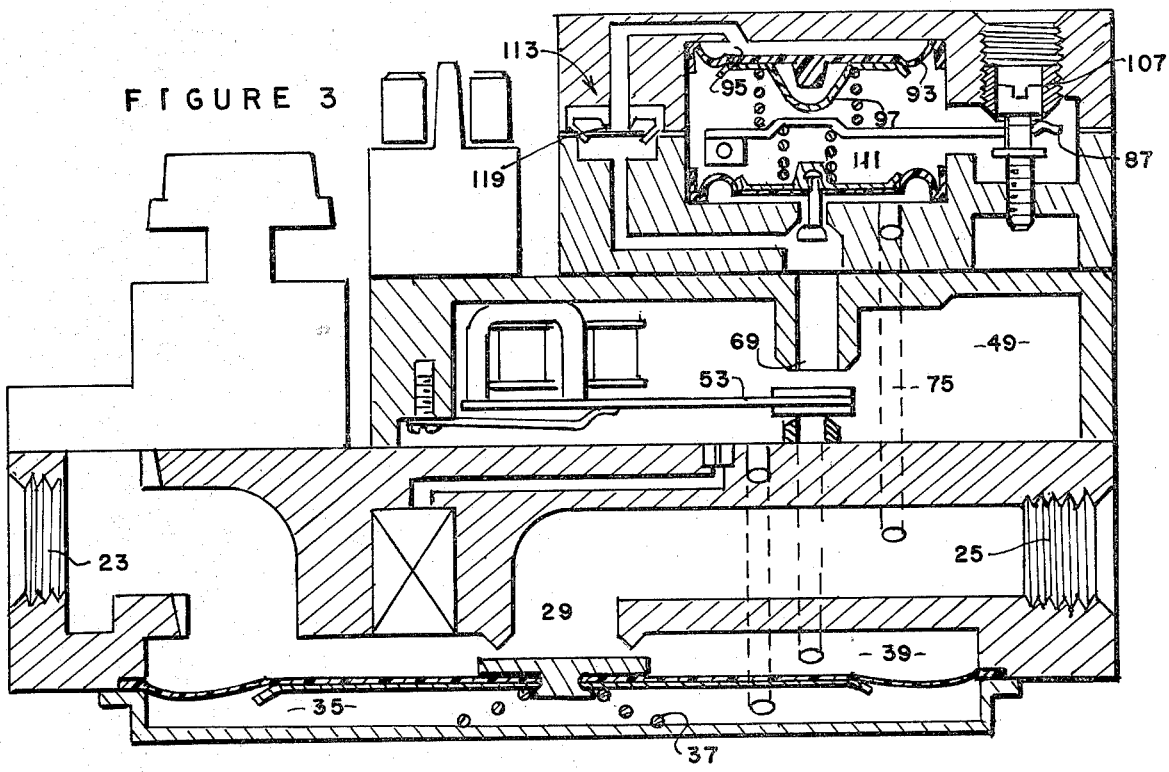
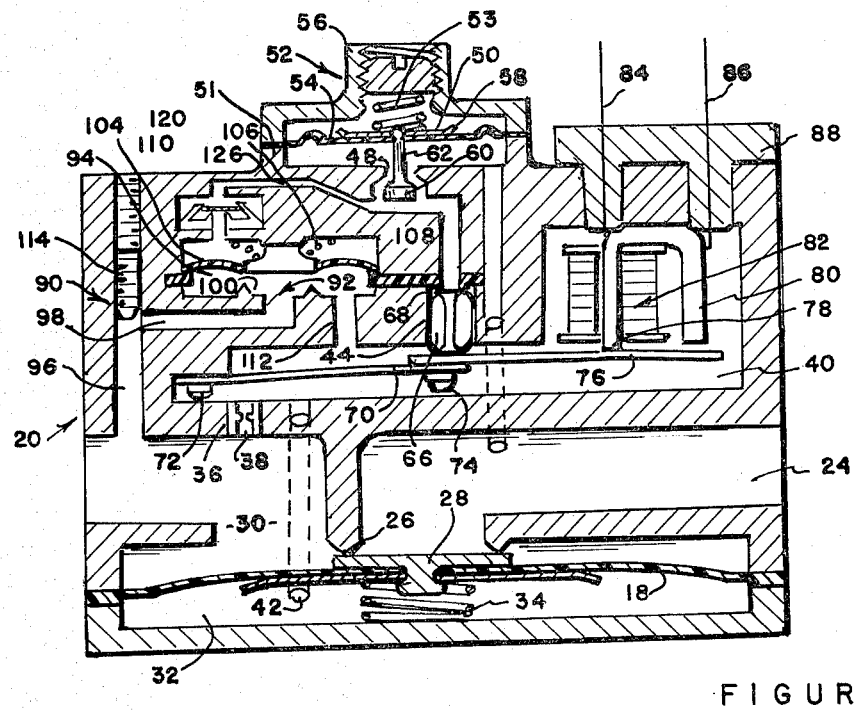
FIGURE 6

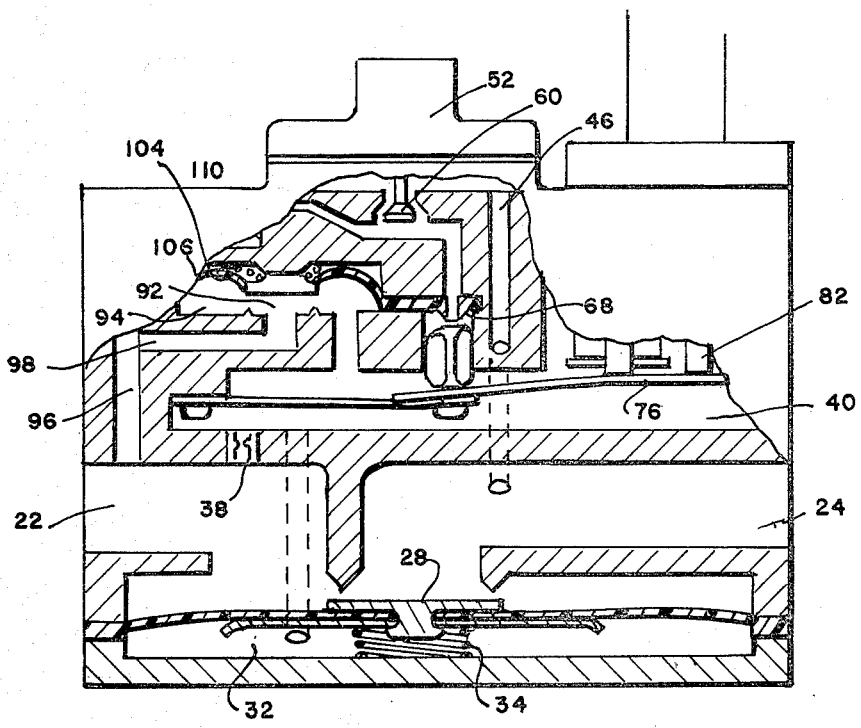
FIGURE 8
FIGURE 9
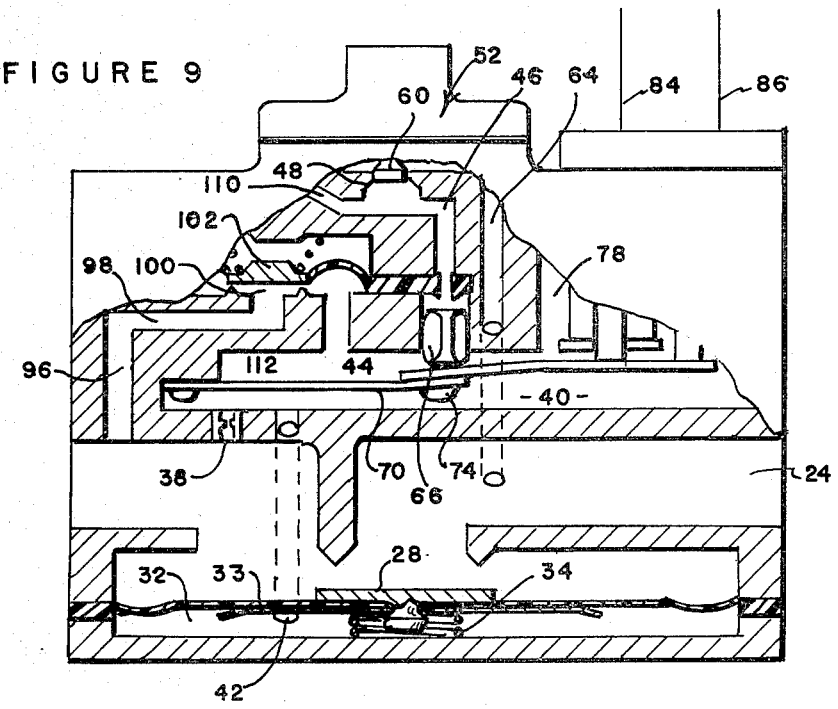

GAS REGULATOR VALVE WITH STEP OPENING CHARACTERISTIC

BACKGROUND OF THE INVENTION

1. Field of the Invention

This invention relates to a fluid control valve and, in particular, to a gas regulator valve useful with gas fired appliances such as space heaters.

2. Brief Statement of the Prior Art

Gas supply control valves for appliances such as space heaters have operating characteristics which are closely specified by the American Gas Association. These operating characteristics have resulted in a fairly common valve design such as illustrated in U.S. Pat. Nos. 3,685,732 and 3,513,873. The valves typically have a housing with inlet and outlet ports separated by a valve member carried on a diaphragm actuator with the opening side of the diaphragm pressured with the gas pressure of a bleed chamber within the housing. The bleed chamber receives the supply gas through a bleed orifice and communicates with the exit port through a snap-acting, heating-demand valve and a pressure regulator valve. The latter has a diaphragm valve actuator and responds to the gas pressure in the exit port of the valve.

The aforedescribed valve structure has a snap opening characteristic and is either off or on, supplying gas at a predetermined, controlled supply pressure. Improvements of the basic structure of these valves have provided a throttled or reduced pressure gas supply upon initial opening of the valve; see U.S. Pat. Nos. 3,354,901 and 3,502,101. This is desirable to establish convection currents in the flue of the appliance before the appliance burner is fully on, thereby avoiding the possibility of flame rollout or other difficulties maintaining combustion of the burner. These valves typically exhibit a step opening characteristic by flow restricting orifices in various internal passageways which control the pressure development in operating chambers of the valves. The flow restricting orifices, however, limit the reset time of the valves. Sudden variations in heating demand such as a rapid opening and closing of the thermostat contacts can exceed the reset capability of these valves, with consequential loss of step opening.

BRIEF STATEMENT OF THE INVENTION

This invention comprises a gas regulator valve having a fast reset capability with a step opening characteristic whereby gas is supplied upon receipt of a heating demand signal, initially at a first, low pressure and, at a relatively fixed and brief time interval thereafter, at a higher, predetermined and regulated pressure. The valve has an extremely fast reset action so that it provides the desired operation of initiating combustion of the main burner of the appliance at a low fire rate for a sufficient time to establish convection currents within the flue and thereby induce a draft in the flue before full combustion even upon rapid opening and closing of the thermostat contacts.

The valve of the invention basically has a housing having gas inlet and outlet ports separated by a diaphragm-controlled valve closure member which responds to pressure applied from an internal bleed cavity within the valve housing. The bleed cavity is supplied with inlet gas through a bleed orifice communicating with the inlet port. The bleed cavity contains the snap acting valve member and an actuator lever coacting with an electromagnet operator that receives the heating demand signal. The snap acting valve discharges into a bleed passageway which communicates, through a pressure regulator valve, with the exit port of the valve housing. The bleed cavity is also in open communication with the pressure chamber of the main valve diaphragm operator.

A step opening characteristic can be provided in this basic structure by either of two modifications. In one modification, the spring operator of the regulator valve can be variably positioned by a step operating diaphragm which is supplied with gas pressure through a passageway containing a flow restricting orifice to provide a slow development of gas pressure behind the step opening diaphragm, to increase the spring force on the regulator valve. In a second embodiment, a passageway bypasses the bleed orifice and includes a valve and diaphragm valve operator which is supplied with gas pressure through a flow restricting orifice. This latter embodiment is the subject of my copending application Ser. No. 938,651 filed Aug. 31, 1978.

In the step-opening valves, the main gas valve initially opens partially and, after a predetermined time, opens further and maintains a constant outlet gas pressure. This invention provides fast reset capability by a check valve which permits unrestricted, reverse flow of gas bypassing the flow restricting orifice of either of the aforedescribed embodiments. The unrestricted reverse flow permits nearly instantaneous relief of the gas pressure from behind the diaphragm controlling the step opening operation, thus providing a very fast resetting of the step opening operation.

BRIEF DESCRIPTION OF THE DRAWINGS

The invention will be described with reference to the drawings of which:

FIG. 3 is a cross-sectional elevational view of the regulator valve of FIG. 1 upon initial opening;

FIG. 6 is a cross-sectional elevational view of another embodiment of the regulator valve in its closed position;

FIG. 8 is a cross-sectional view of the valve of FIG. 6 upon initial opening; and FIG. 9 is a cross sectional view of the valve of FIG. 6 at its full open position.

DESCRIPTION OF THE PREFERRED EMBODIMENT

Figure 1:
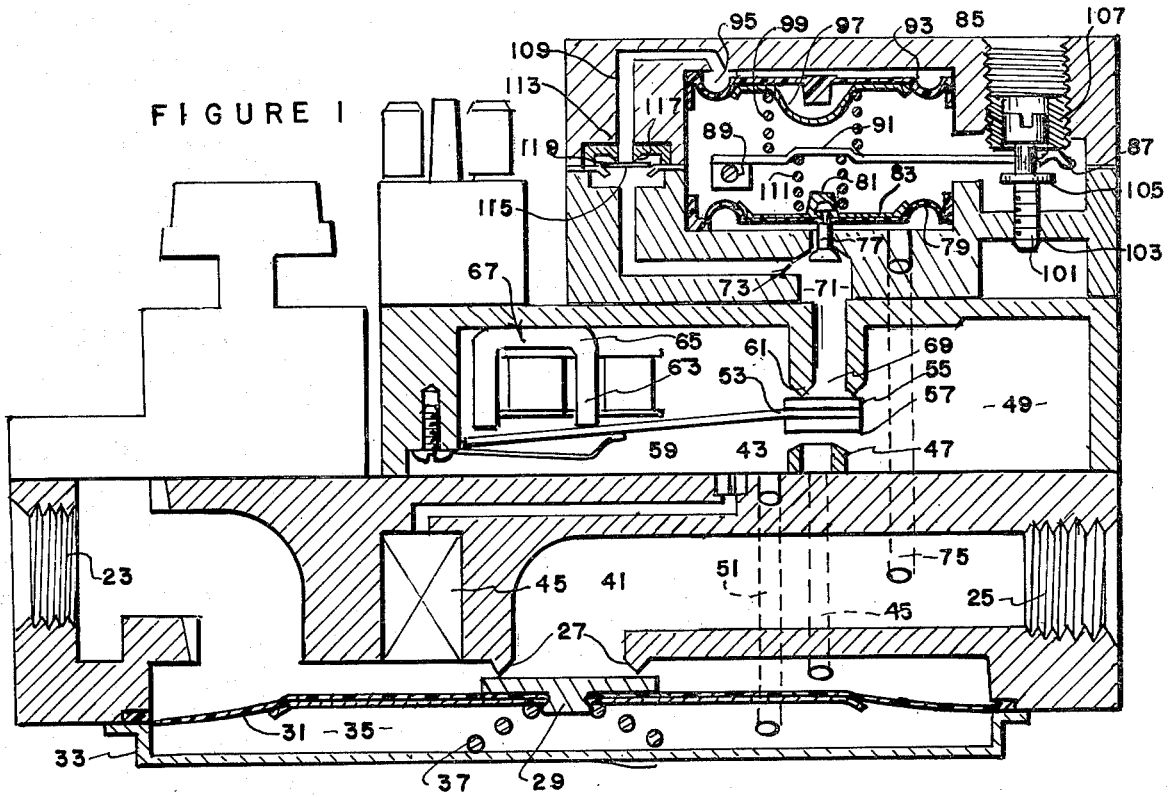
FIG. 1 is a cross-sectional elevational view of the regulator valve of the invention in its closed position.

The invention is illustrated as applied to a step opening gas regulator valve in which the spring operator of the regulator valve is repositioned by a slowly developing gas pressure against a diaphragm to achieve the step opening characteristic. The valve of this type typically comprises a casing 21 having an inlet port 23 for connection to a gas supply and an outlet port 25 for connection to the main burner of a gas fired appliance. The inlet and outlet ports communicate through an internal passageway of the casing having a valve seat 27 with a valve closure member 29 that is carried on a flexible diaphragm 31 having its periphery clamped between the bottom surface of casing 21 in cup 33 which is secured to the casing 21 by cap screws or suitable fasteners, not shown. The diaphragm 18 thus separates an inlet pressure chamber 39 from the main valve operating pressure chamber 35. A coil spring 37 is mounted in compression between the inside face of cup 33 and the valve closure member 29 to bias the latter into closure against valve seat 27.

Internally of casing 21 there is a bleed chamber 49 which is in communication with the inlet pressure chamber 39 through a passageway 41 which contains a flow restricting bleed orifice 43 and a filter 45. The inlet pressure chamber 39 also communicates with bleed chamber 49 through passageway 45 which terminates in bleed chamber 49 with a valve seat 47. The main valve operating chamber 35 communicates also with bleed chamber 49 through an internal valve passageway 51.

Bleed chamber 49 houses an actuating snap valve assembly which comprises a snap valve lever 53 distally supporting, on opposite faces, valve closure members 55 and 57. A resilient leaf spring 59 is provided to bias lever 53, moving valve closure member 55 into a closed position with its respective valve seat 61. The valve closure lever 53 has a fulcrum support on leg 63 of U-shaped pole 65 of an electromagnetic actuator 67.

The valve closure member 57 is moved into and out of closed registration with valve seat 47, controlling the communication between the bleed chamber 49 and the inlet pressure chamber 39. Valve seat 61 surrounds port 69 which discharges into flow passageway 71 that communicates through the regulator valve, generally designated at 73, with internal flow passageway 75 that discharges into the outlet gas port 25 of the housing.

Regulator valve 73 has a valve seat with a moveable valve member 77 that is carried on diaphragm 79 by central boss 81 and spring retainer 83. The valve casing 21 has an upper internal cavity 85 which houses the operating elements of the regulator valve 73. A spring base lever 87 is pivotally mounted within chamber 85 by pin 89. The base lever 87 has a circular upset portion 91 which serves as a retainer for the coil spring 111 which is resiliently biased against spring retainer 83 to function as the resilient spring operator of the regulator valve closure member 77.

The upper portion of chamber 85 houses diaphragm 93 that is sealed about its periphery against the side walls of chamber 85, thereby defining a sealed chamber 95 behind diaphragm 93. Diaphragm 93 centrally carries a conical hat member 97 which projects downwardly, towards the base lever 87. A resilient coil spring 99 is captured between hat member 97 and base lever 87.

The travel of base lever 87 is controlled by machine screw 101 that is threadably engaged in bore 103 and that carries an annular flange 105 to serve as an abutment or limiting stop for base lever 87. Movement of base lever 87 in the opposite direction is limited by the position of threaded sleeve 107 which is received in a threaded bore in casing 21.

The aforedescribed structure is basically similar to step operating pressure regulator valves of conventional manufacture. Pressure is supplied to the chamber 95 behind diaphragm 93 through an internal passageway 109 which bypasses the regulator valve 73 and which contains a flow restricting orifice to achieve a slow accumulation of gas in chamber 95 which flexes diaphragm 93 sufficiently to move the conical member 97 into bearing contact with base lever 87, whereupon continued accumulation of gas effects movement of base lever 87, increasing the spring force on spring retainer 83, urging valve closure member 77 into a more fully open position. This results in a reduction of pressure in the bleed chamber 49 and, since the latter is in open communication with the main gas valve operating chamber 35, a corresponding decrease in pressure in chamber 35. Reduction of pressure in chamber 35 results in movement of the main gas closure valve member 29 into a more fully open position, effecting a step opening characteristic.

The valve as thus described is modified in accordance with the invention by including the check valve generally designated as 113 in the flow passageway 109. The check valve, which is described in greater detail with reference to FIG. 4, includes a flexible disc flapper member 115 which opens to permit unrestricted gas flow from chamber 95 and which closes against valve seat 117 to provide a restricted flow through a small notch 119 in the valve seat 117.

The valve structure is shown in FIG. 1 in its closed position as when receiving no heating demand signal. In this position, the pressures on opposite sides of diaphragm 31, i.e., in the inlet gas chamber 39 and the main valve operating chamber 35 are substantially balanced through communicating passageway 51 and bleed chamber passageway 41, although the force on the inlet side of diaphragm 31 is less because of the area of valve seat 27. Valve closure member 55 is seated against valve seat 59 by resilient leaf spring 61 and bleed chamber 49 is thus pressured through passageway 41 to the inlet gas pressure. When the pressures are balanced in these chambers, the valve closure member 29 is resiliently seated in a closed position by coil spring 37.

Figure 2:
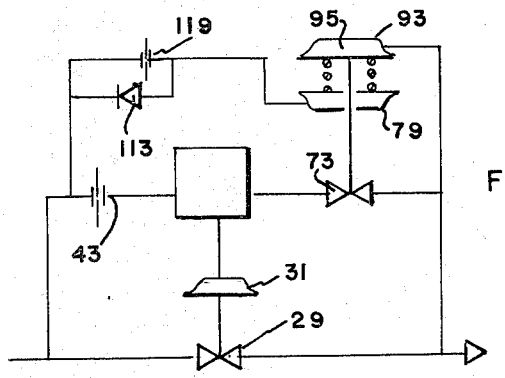
FIG. 2 is a schematic of the valve of FIG. 1.

Referring now to FIG. 2, the valve is schematically illustrated with the gas pressure of bleed chamber 49 applied to diaphragm 31 to close main valve 29. The gas is supplied to bleed chamber 49 through orifice 43 and the pressure in bleed chamber 49 is developed by the differential of flow rates through fixed orifice 43 and the variable opening of regulator valve 73. The latter is spring biased to an open position and is moved closed by diaphragm 79 that responds to valve outlet gas pressure. The time delay orifice 119 provides a slow gas flow to chamber 95 to move diaphragm 93 and increase the spring force applied to open valve 73. Check valve 113 provides a bypass about the delay orifice 119.

Referring now to FIG. 3, the valve structure is shown when it initially receives a heating demand signal. In this position, the valve operating lever 53 has been deflected to open port 69 and supply gas pressure through the orifice 119 to check valve 113, permitting a slow accumulation of gas in chamber 95. The diaphragm 93 initially does not deflect sufficiently to move the conical member 97 against the base lever 87 which remains biased against the low pressure stop, sleeve 107. In this position, spring 111 has a sufficient force to open valve member 77 slightly, permitting a slow flow of gas from bleed chamber 49 through internal passageway 75 to the outlet port 25. The resulting slight reduction in pressure of bleed chamber 49 reduces the pressure in the main valve operating chamber 35 and the main valve closure member 29 deflects to a slightly open position as illustrated.

Figure 4:
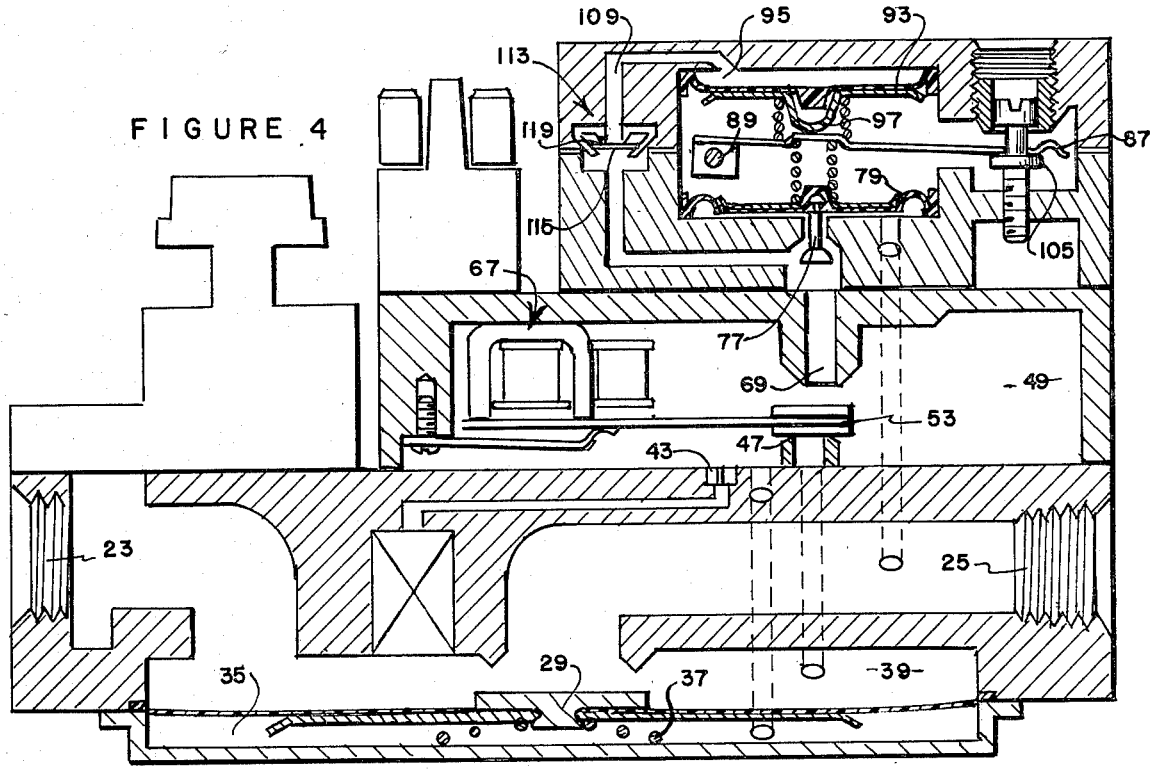
FIG. 4 is an elevational section view of the regulator valve of FIG. 1 at its full open position.

Referring now to FIG. 4, the valve structure is shown in its full-open, pressure-regulating mode. In this position sufficient gas has accumulated in chamber 95 to deflect the diaphragm 93 downwardly, moving the central member 97 into abutment against the base lever 87 and deflecting this lever downwardly against the high pressure stop, annular flange 105. This movement results in a comparable deflection of diaphragm 79 and movement of the pressure regulator valve closure member 77 into a more open position, permitting a more rapid flow of gas from bleed chamber 49, which receives a limited flow of gas through the flow restricting bleed orifice 43. This results in a reduction of pressure in bleed chamber 49 and in the communicating main valve operating chamber 35 and results in a further deflection of the main valve closure member 29 to the open position illustrated in FIG. 4.

Upon cessation of the heating demand signal, the armature 65 releases the valve lever 53 which moves away from engagement with valve seat 47 and permits rapid refilling of chamber 35 through passageway 45, thereby allowing the force of spring 37 and the differential pressure of chambers 35 and 39 to close valve 89.

This invention provides a comparably rapid resetting of the step operating regulator valve 73. The reduction of pressure in bleed chamber 49 reduces the pressure in flow passageway 111 and the higher pressure within chamber 95 deflects the flapper member 115 into a full open position, dumping the gas within chamber 95 through the regulator valve 73 and internal passageway 75.

Figure 5:
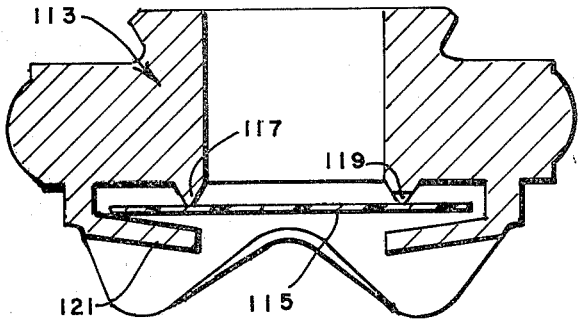
FIG. 5 is a sectional view of the flow restricting check valve used in the valve of FIG. 1.

Referring now to FIG. 5, the flow restricting check valve will be described. This valve, as previously mentioned, has a flexible disc flapper 115 which seats against valve seat 117 when pressure is applied to the exposed face of the closure member 115. In this closed position, a limited flow of gas passes through notch 119 in valve seat 117. When flow is applied in the opposite direction, however, flexible disc flapper member 115 moves away from valve seat 117 and is restrained in the assembly by folded tabs 121. The flow in this direction is, however, substantially unimpeded and the check valve 113 thus provides unrestricted flow in one direction but a restricted and controlled rate of flow in the opposite direction.

Referring now to FIG. 6, the invention is illustrated with a gas regulator valve having a step opening characteristic that is achieved by a bleed orifice bypass. This control valve comprises a casing 20 having an inlet port 22 on one end connected to a gas supply and an outlet port 24 on the opposite end connected to the main burner of the gas fired appliance. The inlet and outlet ports 22 and 24 are disposed on a common axis with a valve seat 26 therebetween. A flow through valve seat 26 is controlled by a flexible diaphragm 18 which carries a main valve member 28. The periphery of the diaphragm is clamped between adjacent sections of casing 20 which are secured together as by cap screws (not shown). The main diaphragm valve 28 separates a hollow cavity of the casing into an inlet pressure chamber 30 and an operating pressure chamber 32. A backup plate is secured to the undersurface of diaphragm and a coil spring 34 is mounted in compression between the bottom casing wall of the operating pressure chamber 32 and the backup plate whereby the diaphragm valve 28 is biased toward engagement with the valve seat 26.

A bleed passage 36 having a flow restriction orifice 38 establishes communication between the inlet port 22 and a bleed chamber 32 by means of passageway 42. One wall of chamber 40 has a circular port 44 communicating with a bleed discharge passageway 46 which discharges through valve seat 48 into the operating pressure chamber 50 of the regulator 52. This regulator has a diaphragm 54 that has its periphery clamped between an annular shoulder 51 on the outer wall of the casing 20 and a circular diaphragm casing 56. A circular plate 58 is mounted to a central area of diaphragm 54 and this plate bears valve member 60 on stem 62. Valve member 60 is mounted in alignment with valve seat 48 for movement in and out of registration with this valve seat by flexing of the diaphragm 54.

The operating pressure chamber 50 of the diaphragm valve regulator 52 is connected to the outlet 24 of the valve through a discharge passageway 64, which vents the bleed chamber 40.

The bleed chamber 40 houses the snap valve assembly comprising a valve and a non-circular cross-section stem member 66. the member 66 seats against the annular valve seat 68 surrounding the discharge flow passageway 46. The valve member is biased into registration with the valve seat 68 by a resilient spring member 70 that is secured to the casing 20 by fastener 72 and that has its free end secured to the member 66 by fastener 74. The assembly also includes an actuator lever 76 that projects to a fulcrum engagement with leg 78 of U-shaped pole 80 of the electromagnetic actuator 82 and thus functions as a magnet armature. The coil of actuator 82 is connected to leads 84 and 86 that extend through insulator plate 88 received in the casing 20.

This valve has a step opening characteristic by inclusion of bypass means, generally indicated at 90, which bypasses the bleed orifice 38 to provide communication between the inlet port 22 and bleed chamber 40 through valve 92. This bypass means includes a bypass passageway which discharges into a cavity 94 within the casing 20. The discharge passageway, which is formed of a first bore 96 and an intersecting bore 98 discharges into cavity 94 past an annular valve seat 100. The cavity 94 also houses a diaphragm valve operator for the valve member 102. To this end, valve member 102 is carried by a central portion of diaphragm 104 which is clamped at its peripheral edges to the casing 20. A resilient helical coil spring 106 is provided to resiliently bias the valve member 102 into a closed registration with the annular valve seat 100.

The operating pressure chamber 108 of the diaphragm valve operator is interconnected to the discharge passageway 46 through a delay orifice 110, upstream of the regulator valve 60 and valve seat 48. Cavity 94 also communicates directly through port 112 to the bleed chamber 40. A bypass restrictor valve in the form of a threadably received set screw 114 is provided in the flow passageway 96. This set screw has a rounded lower end and can be advanced or retracted in the passageway 96 to provide a variable flow area through this passageway.

Rapid resetting of the step opening operation is achieved by check valve 120 in the operating pressure chamber 108 of the bypass valve operator. The check valve 120 is similar to that of FIG. 5 with a disc flapper 115 that seats on an annular valve seat 117 and that discharges to passageway 126 communicating with the gas discharge passageway 46, upstream of the regulator valve member 60. This construction functions to provide a check valve parallel to the delay orifice 110 which will provide a quick venting of the operating pressure chamber 108 of the diaphragm operator for the valve member 102. This permits a more rapid recycling of the valve structure by providing a very rapid reset of the bypass valve to its open position shown in FIG. 6.

Figure 7:
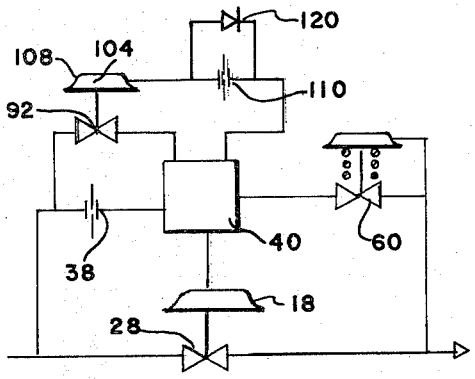
FIG. 7 is a schematic of the valve of FIG. 6.

Referring now to FIG. 7, the valve schematically includes main valve 28 responsive to diaphragm 18 which receives gas pressure from bleed chamber 40. The pressure in bleed chamber 40 is a function of the relative rates of flow through fixed orifice 38, bypass valve 92 and regulator valve 60. The latter is spring biased open and closes under increased outlet gas pressure. Flow through valve 92 is varied by the slow accumulation of gas pressure on diaphragm 104 through time delay orifice 110. This valve is open initially but closes as the gas pressure develops, resulting in a time-delayed decrease in pressure in bleed chamber 40 and a time-delayed further opening of valve 28. Check valve 120 bypasses delay orifice 110 and permits rapid venting of gas in chamber 108 to permit rapid resetting of valve 92.

FIG. 6 illustrates the control valve with the main gas valve 28 closed and the electric actuator 82 not energized. This is the normal, off configuration. In this position, the inlet pressure is applied to cavity 94 and the valve member 102 is open, compressing the bypass valve spring 106. The bypass valve diaphragm operating pressure chamber 108 is at the pressure of the outlet port 24, atmospheric pressure, since it communicates through the opened regulator valve 60 and discharge passageway 64 to the outlet port 24.

Referring now to FIG. 8, the valve is shown when the electromagnetic operator 82 is initially actuated. The actuator attracts the end of the snap valve operating lever 76, moving the valve and stem member 66 away from the valve seat 68 and permitting the flow of gas from bleed chamber 40 through the passageway 46 to the regulator valve 60. During the initial opening states of the valve, the bypass means is effective to permit gas flow through passageways 96 and 98 into the cavity 94 through the open valve 92. This flow passes through port 112 into bleed chamber 40, establishing a bypass communication into this chamber about the bleed orifice 38.

The bypass means provides a relatively large flow of gas to bleed chamber 40 which is passed to the regulator valve 60 through the discharge passageway 46. The pressure in passageway 46 is approximately equal to the pressure on the underside of the bypass valve diaphragm (chamber 92). This pressure is applied through the delay orifice 110 to the upper side of diaphragm 104, equalizing the pressure on both sides of the diaphragm and permitting spring 106 to close the valve member 102.

The pressure of the bleed chamber 40 decreases as a result of the venting of the chamber through the discharge passageway 46 past the regulator valve 60. The main valve operating pressure chamber 32 likewise declines in pressure and the inlet pressure applied to the upper side of the diaphragm of the main valve operator opens the main valve 28 slightly permitting gas to be discharged to the outlet port 24.

When the pressure of the operating pressure chamber 108 of the bypass valve operator reaches the pressure in the bleed chamber 40, a time interval which is controlled by the proper sizing of the delay orifice 110, the bypass valve 102 moves, under the influence of coil spring 106 to a fully closed relationship on valve seat 100. This closes the bypass passageway to further flow and bleed chamber 40 receives gas only through the bleed orifice 38, at a rate controlled by the size of this orifice. The valve now moves to the second step of its opening which is illustrated in FIG. 9. In this position, the bleed chamber 40 is at a reduced pressure, which is communicated through passageway 42 to the main valve operating pressure chamber 32, causing the main valve member 28 to move to its full open position as shown in FIG. 9. In this position, the regulator valve 60 functions to maintain the pressure in the discharge passageway 24 at a predetermined, constant value. This value is maintained by balancing of the pressure on the underside of the valve operator diaphragm 54 against the bias of helical coil spring 53, increasing pressure in discharge port 24 causing closure of valve member 60 in a pressure regulating manner.

The valve returns to its closed position shown in FIG. 1, upon interruption of the signal to the electromagnetic snap valve actuator 82. The actuator 82 releases the actuator valve and stem member 66 for closing under the influence of resilient spring 70. This valve snaps closed and the pressure in the bleed chamber 40 rises, closing the main valve 28. Check valve 120 permits a rapid decrease of pressure in bypass cavity 108, quickly opening valve 102 and permitting inlet gas to flow into bleed chamber 40 through passageways 96, 98 and 112. This permits rapid closing of valve 28. At this pressure climbs, the bypass diaphragm valve opens slowly and the valve is restored to the condition shown in FIG. 1.

Figure 10:
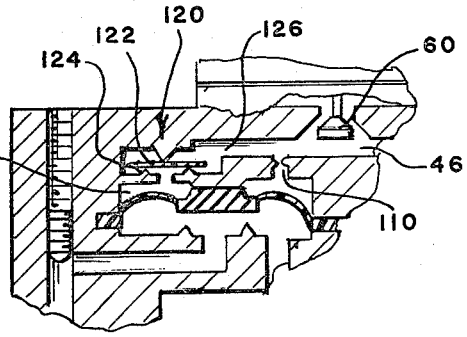
FIG. 10 is a cross-sectional view of another embodiment.

Referring now to FIG. 10, an alternative construction is illustrated. As there shown, the operating pressure chamber 108 of the bypass valve operator is provided with a separate check valve means 120. The check valve means comprises a disc flapper 122 that seats on an annular valve seat 124 and that discharges to relief passageway 126 communicating with the gas discharge passageway 46, upstream of the regulator valve member 60. This construction functions to provide a check valve parallel to the delay orifice 110 which will provide a quick venting of the operating pressure chamber 108 of the diaphragm operator for valve member 102. This permits a rapid recycling of the valve structure by providing a very rapid reset of the bypass valve to its open position shown in FIG. 6.

The valve of the invention thus has a step opening characteristic wherein gas is supplied to the valve outlet at an initial or first step opening with a reduced outlet pressure which is sufficient for ignition and establishing a draft through the flue of the appliance. Thereafter, the valve moves to its second step or full open position and the possibility of flame rollout or malfunction is greatly reduced. The valve also exhibits the step opening characteristic relatively independent of changes in the inlet gas pressure since the time duration between the first and second step openings remains relatively constant for a wide range of inlet gas pressures.

Both embodiments of the valve exhibit very fast recycling of the step opening characteristic since the check valve 113 permits unrestricted flow of gas which bypasses the flow restricting delay orifices used to achieve the step opening operation.

The invention has been described with reference to the presently preferred and illustrated embodiments. It is not intended that the invention be unduly limited by this disclosure or preferred embodiments. Instead, it is intended that the invention be defined by the means, and their obvious equivalents, set forth in the following claims.

What is claimed is:

1. In a step opening gas pressure regulating valve having a housing with inlet and outlet ports separated by a main diaphragm valve with a main valve diaphragm chamber and including a bleed chamber within said housing in communication with said main valve diaphragm chamber with a bleed chamber inlet gas passageway containing a gas bleed orifice and a bleed chamber outlet gas passageway whereby said main valve responds to gas pressure in said bleed chamber and wherein a step opening diaphragm is mounted in a step opening diaphragm chamber which communicates with the bleed chamber through a time delay orifice and gas flow control means responsive to said step opening diaphragm is mounted in one of said inlet and outlet gas passageways, the improvement which comprises check valve means bypassing said time delay orifice to vent said step opening diaphragm chamber and thereby provide rapid resetting of step opening diaphragm.

2. The valve of claim 1 including regulator valve means in the outlet gas passageway from said bleed chamber with a regulator diaphragm and a regulator diaphragm chamber open to said outlet port with resilient means biasing said regulator valve means to an open position.

3. The valve of claim 2 including snap valve means in the outlet gas passageway from said bleed chamber and a snap valve actuator located within said housing and responsive to a signal external of said valve.

4. The valve of claim 3 wherein said bleed chamber communicates with the inlet pressure chamber of said main valve through a relief passageway and including a relief valve closure member moveable into and out of closure of said relief passageway.

5. The valve of claim 4 wherein said relief valve closure member is carried on said snap valve actuator lever.

6. The valve of claim 2 wherein said resilient means bears against a variable position base lever and wherein said step opening diaphragm carries an actuator to vary the position of said base lever.

7. The valve of claim 6 wherein said check valve means includes a flapper valve closure member which engages a valve seat and wherein said time delay orifice is a notch in said valve seat.

8. The valve of claim 2 wherein said housing includes a bypass passageway communicating between said inlet port and bleed chamber independently of said bleed orifice means and including diaphragm controlled bypass valve means in a bypass cavity of said housing subdivided by the bypass diaphragm of said diaphragm controlled valve means into a first pressure chamber in open communication with said bleed chamber and a second pressure chamber in communication through said time delay orifice with said bleed chamber outlet gas passageway said snap valve and regulator valve means.

9. The valve of claim 8 wherein said check valve means includes a check valve gas passageway communicating between said bleed chamber outlet gas passageway and said second pressure chamber.

10. The valve of claim 8 wherein said check valve means includes a flapper valve closure member which engages a valve seat and wherein said time delay orifice is a notch in said valve seat.

* * * * *